US007537508B1

(12) United States Patent
Picone et al.

(10) Patent No.: US 7,537,508 B1
(45) Date of Patent: May 26, 2009

(54) CARBIDE MODEL ROCKETRY SYSTEM

(75) Inventors: John Picone, Oceanside, NY (US); Nicholas Picone, Oceanside, NY (US)

(73) Assignee: Picone Products, Inc., Oceanside, NY (US)

( * ) Notice: Subject to any disclaimer, the term of this patent is extended or adjusted under 35 U.S.C. 154(b) by 556 days.

(21) Appl. No.: 11/391,701

(22) Filed: Mar. 29, 2006

Related U.S. Application Data

(60) Provisional application No. 60/665,877, filed on Mar. 29, 2005.

(51) Int. Cl.

| | |
|---|---|
| ***A63H 29/00*** | (2006.01) |
| ***A63H 27/00*** | (2006.01) |
| ***A63H 27/26*** | (2006.01) |
| ***F41B 11/00*** | (2006.01) |

(52) U.S. Cl. ..... 446/429; 446/231; 446/212; 124/65; 124/73

(58) Field of Classification Search ..... 446/429, 446/212, 231; 244/63; 124/73
See application file for complete search history.

(56) References Cited

U.S. PATENT DOCUMENTS

| | | | | |
|---|---|---|---|---|
| 6,679,155 | B1 * | 1/2004 | Yaschur et al. | 89/1.813 |
| 2002/0121214 | A1 * | 9/2002 | Ledys et al. | 102/477 |

* cited by examiner

*Primary Examiner*—Gene Kim
*Assistant Examiner*—Michael D Dennis
(74) *Attorney, Agent, or Firm*—Berenato, White & Stavish, LLC.

(57) ABSTRACT

A model rocket and launch system in which a rocket is launched by combustion produced from a mixture of water and calcium carbide. The water and calcium carbide are combined in a mixing container and launch tube and create a combustible gas. The container and launch tube incorporates a spark chamber consisting of a spark element device and electrode. Both the rocket body tube and launch tube includes a conductive coupling device and is designed to be co-dependent of each other in order to complete an electrical circuit for ignition purposes. The launch tube conductive coupling device and is electrically connected to a spark element device. Electrical current is sent to the spark element device and electrode when the electrical current provided from a high voltage generator passes through both the model rocket unit and the launch system unit via the combined conductive coupling devices. The spark element device and electrode located in the mixing container create a spark and ignites the calcium carbide gas mixture. The rapidly expanding gases from combustion enters the launch tube. A model rocket mounted over the launch tube is thrust forward from the expanding gases and launched into flight. The model rocket and launch system further incorporates safety devices designed to prevent accidental ignition and misuse and tampering of the launch system.

20 Claims, 22 Drawing Sheets

Fig. $4A_1$

Fig. $4C_1$

Fig. $4E_1$

Fig. $4F_1$

Fig. $4G_1$

Fig. $5A_1$

Fig. $5B_1$

Fig. $5C_1$

Fig. $5D_1$

Fig. 5G$_1$

Fig. $5I_1$

Fig. $5J_1$

Fig. $7B_1$

Fig. $7C_1$

Fig. $7D_1$

Fig. 9A
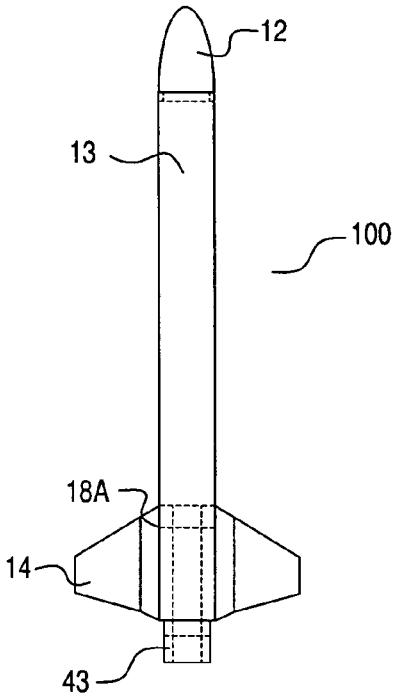
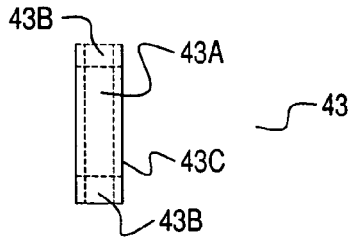
Fig. 9A 1
Fig. 9B
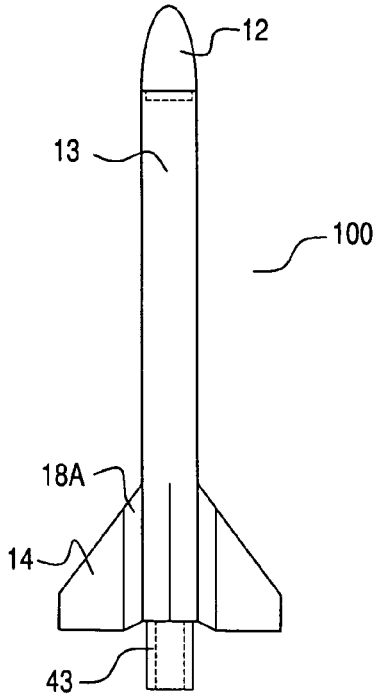

Fig. 9D2

Fig. $11D_1$

CARBIDE MODEL ROCKETRY SYSTEM

This application claims the benefit of U.S. Provisional Patent Application No. 60/665,877 filed on Mar. 29, 2005 entitled "CARBIDE MODEL ROCKETRY SYSTEM" and is hereby incorporated herein by reference.

BACKGROUND OF THE INVENTION

1. Field of the Invention

The present invention relates broadly to model rocketry and launch systems and more particularly to model rockets that utilize "pressurized gases" to launch rockets in lieu of "solid" or "liquid" propellants.

2. Description of the Prior Art

For over 100 years the prior art model rockets have been launched and powered by rocket engines consisting of solid fuel rocket propellants and liquid rocket fuels; Because of the recent increase of safety requirements and law regulations, the availability of solid rocket propellants and liquid rocket fuels have become limited and prohibited in use to most amateur model rocketeers. The result is diminishing the hobby of model rocketry. Concerned manufactures are producing alternate means and safer rocketry where the rocket engines consisting of propellants and fuels are eliminated. Model rocket manufactures have alternately switched to "pressurized gas" systems to launch rockets safely. An air rocket 1 as shown in the prior art FIG. 1, utilizes manually operated hand and/or foot air pumps 2 and 3 respectively to pressurize the launch system 4 and release them into the air rocket 1 to launch and thrust them into flight.

A hydrogen model rocket 5 as shown in FIG. 2, utilizes a solution of citric acid crystals and water and is broken down by electrolysis in a fuel generator 6, where the gas is collected into a reaction chamber 7 and then heated by an element 8 to ignite the "hydrogen gas". The hydrogen gas expands to thrust the hydrogen rocket 5 into flight. Alternately, solutions are mixed such as vinegar and baking soda to create expanding gases by a chemical reaction (not shown) to launch and thrust some model rockets. However, prior art model rocket "pressurized systems" suffer certain drawbacks whereas the air rockets "hand" and "foot pump" pressurization process requires physical and laborious time and effort actions to launch a model rocket and there is always the possibility of suffering a hand, wrist, or foot and ankle injury.

The hydrogen rocket launch system is a complex unit that contains to many sensitive parts where many things can go wrong. The hydrogen rocket has a delayed launching cycle whereas it takes between 2-5 minutes to generate and produce hydrogen from the solution and another several seconds to heat up and ignite the hydrogen for launching. The generator and ignition system require an extensive battery pack of 6 "D" sized batteries located in base 9 and if the battery pack is not fresh, ignition time is further delayed and/or misfire occurs. If the heating element and igniter get wet from the water solution this will further delay the launch process again and possibly a misfire may occur.

SUMMARY OF THE INVENTION

The present invention is a new improved model rocketry system as compared to the prior arts. It is therefore an object of the present invention to provide for a novel, safe and reliable easy-to-use model rocketry system.

In accordance with the present invention, the model rocketry system comprises of a model rocket unit and a launch system unit. Whereas, the model rocket unit includes a hollow rocket body tube and the launch system unit includes a hollow launch tube that is compatibly designed as to structurally slip-fit to one another. Both the rocket body tube and launch tube includes a conductive coupling device and is designed to be co-dependent of each other in order to complete an electrical circuit for ignition purposes. The launch system unit further comprising of an upper portion and lower portion, with the lower portion including a mixing container constructed of a bottle or jar supported by a base and incorporating at least one internally mounted electrode affixed in the mixing container. The mixing container having a dual function, whereas the mixing container is utilized to combine a solution of water and calcium carbide to form a gas and utilized to create a spark and ignite the solution to launch a model rocket. The launch system unit upper portion consisting of a closure cap provided with means to accept a spark element device and launch tube. Whereas the launch tube includes an end portion flange with a length of hollow tubing. The launch tubing portion further incorporates an internally affixed conductive coupling device and is electrically connected to a spark element device. The upper and lower portions of the launch system unit are connectively combined via the closure cap whereas, the launch tube end flange portion and spark element device are mounted atop of the mixing container and then encapsulated and affixed by the closure cap by threading or other locking means. The launch system unit works when a solution of water and calcium carbide media are combined to create a combustible gas. The carbide media can be made of a consistency of powder, partially granulated particles, or solid form. Carbide media is measured and introduced either manually by pouring or spooning into the opening of the launch tube to meet with the water in the mixing container, or by mechanical means by a loader integrally built into the mixing container.

The mixing container further incorporates a spark element device and electrode. Electrical current is sent to the spark element device and electrode when the electrical current provided from a high voltage generator passes through both the model rocket unit and the launch system unit via the combined conductive coupling devices. The spark element device and electrode located in the mixing container create a spark and ignites the calcium carbide gas mixture. The rapidly expanding gases from combustion enters the launch tube. A model rocket mounted over the launch tube is thrust forward from the expanding gases and launched into flight.

The model rocket unit further comprising of an upper portion and lower portion, with the lower portion including a rear conductive portion, two or more stabilizing fins, and whereas at least one stabilizing fin is conductive. The upper portion including a rocket body tube and a nose cone, and a conductive coupling device affixed within the rocket body tube. The model rocket unit upper and lower portions are electrically connected to one another. A wire from a spark generator is connected to a conductive stabilizing fin via an alligator clip. Current passes through the conductive stabilizing fin and transferred to the rocket conductive coupling device. The model rocket unit and launch system unit conductive coupling devices are inherent safety devices designed to prevent accidental ignition and misuse and tampering of the launch system. The model rockets are flight-recyclable and there are several types of flight recovery systems for repeated launch uses.

In accordance with the first embodiment of the present invention, the model rocketry system is comprised of a model rocket unit and a launch system unit. The launch system unit includes a first mixing container with an electrode, a closure cap, a first spark element device, a first launch tube, a first conductive coupling device and a spark generator. The mixing container is fitted and supported into a base. The base contains different diametrical size cavities and is suitable to fit and support multiple sized mixing containers. The launch tube contains a first internally affixed conductive coupling device and is electrically connected to the spark element device. The spark element device is located below the closure cap and situated nearest the electrode in the mixing container.

The spark element device and the electrode are spaced accordingly with an air gap to promote a spark to travel between the two points. The model rocket unit includes a model rocket having a nose cone, stabilizing fins and a hollow body tube that is receiveably mountable via a slip-fit over the launch tube. The rocket body tube further incorporates a first internally affixed conductive coupling device and is electrically connected to a first conductive stabilizing fin. When the model rocket unit is mounted to the launch tube, both the conductive coupling devices make contact with one another to complete an electrical circuit. At least one wire from a spark generator is connected to a conductive stabilizing fin and the other wire connected to the launch system electrode.

In accordance with the second embodiment of the present invention, the model rocket unit incorporates a tube within a tube, whereas the lower portion of the rocket body tube has a second diametrically smaller hollow tube extending out towards the rear of the model rocket, and substantially further extending a length beyond the stabilizing fins. The smaller diameter extended tube is conductive and is compatibly designed as to structurally slip-fit into the launch tube and acts as both the conductive coupling device and spark element device when used in conjunction with a modified launch system unit. The modified launch system unit in accordance with the second embodiment of the present invention consisting of a single-unit mixing container and base. The modified launch system unit further comprising of a hollow launch tube incorporating a spring-loaded, swinging-door mechanism, actively moved open or closed by action of connecting and disconnecting the model rocket.

In accordance with the third embodiment of the present invention, the model rocket unit incorporates a tube within a tube, whereas the lower portion of the rocket body tube has a second diametric hollow conductive tube extending out towards the rear of the model rocket. The inner diameter of the extended tube is compatibly designed as to structurally slip-fit over the launch tube, whereas, the outer diameter portion of the extended tube is compatibly designed as to structurally slip-fit and seat into a hub located at the base of a modified launch tube. Below the hub and seat portion of the modified launch tube is a spark element device. The extended tube makes contact with the spark element device and acts as a conductive coupling device to complete the electrical circuit.

In accordance with the fourth embodiment of the present invention, the model rocket unit nose cone, body tube and stabilizing fins are constructed of a conductive material such as a conductive foam, plastic or combination thereof. The launch system unit includes a hollow launch tube that is also constructed of a conductive foam or plastic. The model rocket can be structurally designed as to slip-fit over or into the conductive launch tube to complete the electrical circuit.

BRIEF DESCRIPTION OF THE DRAWINGS

Other objects and advantages of the invention will become apparent from a study of the following specification when viewed in light of the accompanying drawings, wherein:

FIG. 5A, 5B, 5C, 5D, 5E, 5F, 5G, 5H, 5I, 5J, are perspective views of launch system units in accordance with the first exemplary embodiment of the present invention showing different structural arrangements of launch tube conductive coupling device, electrodes and spark element devices;

FIG. 9A, 9B, 9C, are perspective views of model rocket units in accordance with the third exemplary embodiment of the present invention, showing different structural arrangements of a model rocket conductive coupling device;

DETAILED DESCRIPTION OF PREFERRED EMBODIMENTS

The preferred embodiments of the present invention will now be described with reference to accompanying drawings.

Figure 1:
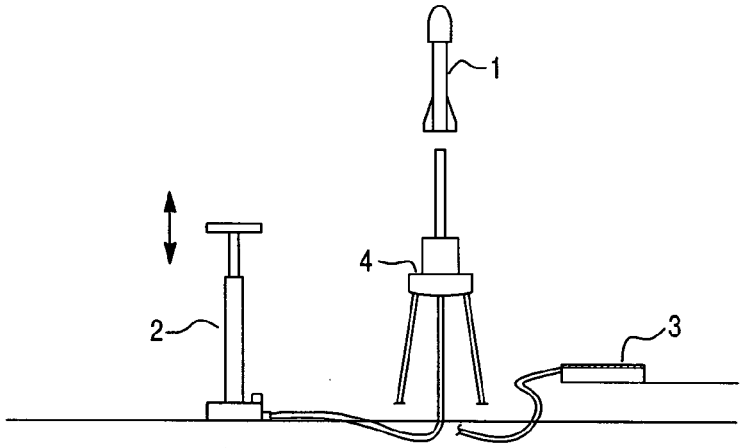
Fig. 1 Prior Art
FIG. 1 is a perspective view showing an air model rocket and launch system of the prior art.
Figure 2:
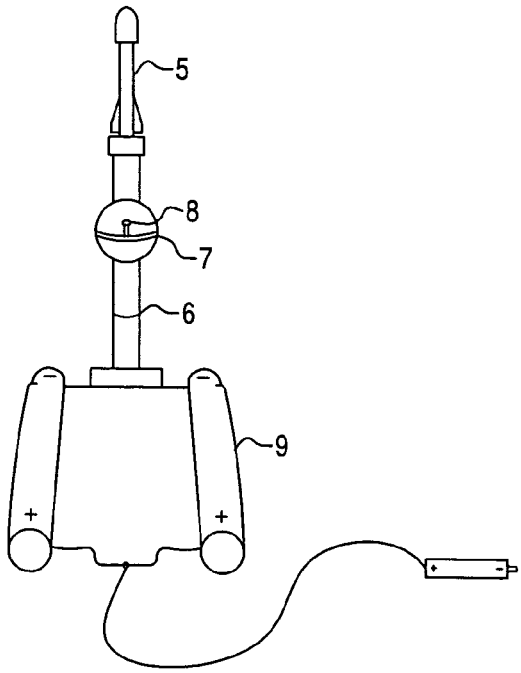
Fig. 2 Prior Art
FIG. 2 is a perspective view showing a hydrogen model rocket and launch system of the prior art.
Figure 3:
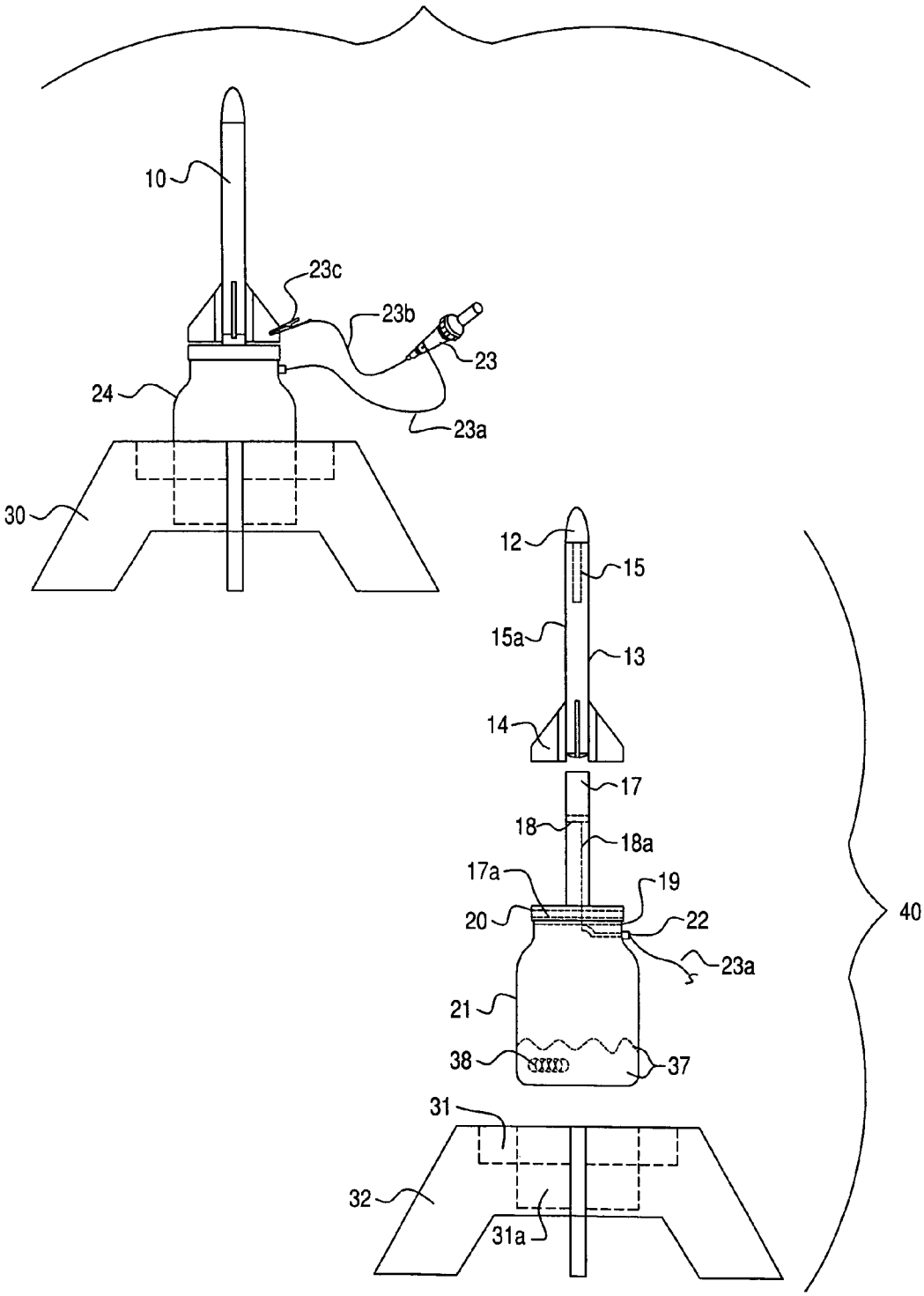
FIG. 3 is a perspective view of a carbide model rocket and launch system in accordance with the first embodiment of the present invention.

Referring now to FIG. 3 an improved model rocketry system in accordance with the first embodiment of the present invention illustrated generally at 40 and comprises a model rocket unit 10, a launch system unit 24 and a base 30. Whereas the model rocket unit 10 includes a hollow rocket body tube 13 with attached conductive stabilizing fins 14 and a nose cone 12 having an integral conductive coupling device 15 in the form of a solid extended shaft member shown in better detail at FIG. $4E_1$. The rocket conductive coupling device 15 is affixed inside rocket body tube 13 and is electrically connected to a conductive stabilizer fin 14 via a strip of metallic foil tape or wire 15A attached to the rocket body tube 13 shown in better detail at FIG. 4E.

Whereas the launch system unit at 24 comprises of a mixing container 21 in the form of a jar or bottle, a closure cap 20, an internally mounted elbow-shaped electrode 22, a hollow launch tube 17 with an integral end flange 17A, a launch tube conductive coupling device 18 in the form of a conductive ring as shown in better detail at FIG. 5$A_1$. Conductive ring 18 is attached to the inside diameter of launch tube 17 with glue and is electrically connected to a spark element device 19 with a strip of metallic foil tape or wire 18A affixed to the inner diameter of launch tube 17. The spark element device 19 is shaped in the form of a large washer as shown in better detail at FIG. 11B. The spark element device 19 and launch tube 17 are combined to form an assembly, whereas the spark element device washer 19 rests on top of mixing container threads 20A and the launch tube end flange 17A rests on top of the spark element device 19. Threaded closure cap 20 with integral centering hole 20B is then placed over the launch tube 17 and fastened to mixing container threads 20A to encapsulate the assembly as shown in better detail at FIG. 11B. A spark generator 23 is electrically connected between the model rocket unit 10 and the launch system unit 24 with a grounding wire 23A and positive wire 23B. Whereas grounding wire 23A is electrically connected to electrode 22 and positive wire 23B is electrically connected by attaching alligator clip 23C to a conductive stabilizing fin 14. Spark generator 23 can be in the form of a push button piezo electrical igniter, a battery generated spark produced by a coil or any other appropriate method that are well known in the prior arts is within the scope of the present invention. Mixing container 21 is fitted into a base 30 whereas base 30 has multiple cavities 31 and 31A that can receive and support multiple sized mixing containers 21. Multiple spaced support legs 32 are integral to base 30.

The model rocket unit 10 and launch system 24 are co-dependent of each other because the two units need to be joined in order to produce continuity and complete the electrical circuit to have ignition occur properly. Thus, it will be appreciated that when the model rocket unit 10 is properly joined to the launch system unit 24 the rocket conductive coupling device 15 will engage and touch the launch tube conductive coupling device 18 activating continuity and transfer of electrical conductivity between the two units.

The rocket conductive coupling device 15 and the launch tube conductive coupling device 18 are mechanical coupling devices that are designed to engage and touch one another in order to transfer the electrical power produced from the spark generator 23 to the electrode 22 and spark element device 19. Those skilled in the art will appreciate that the rocket conductive coupling device 15 and the launch tube conductive coupling device 18 may be of any appropriate design to facilitate continuity and transfer of electrical conductivity between the model rocket and launch system.

Figure 4A:
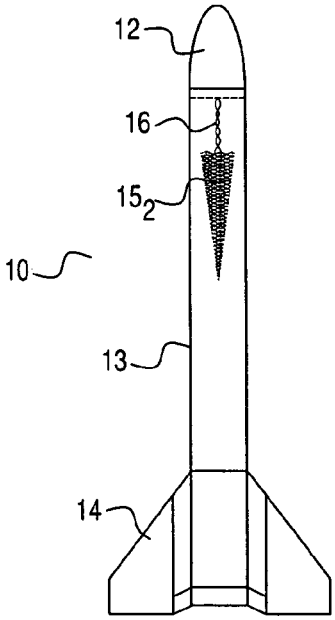
FIG. 4A, 4B, 4C, 4D, 4E, 4F, 4G, are perspective views of model rocket units in accordance with the first exemplary embodiment of the present invention showing different structural arrangements of model rocket conductive coupling devices.
Figure 4A:
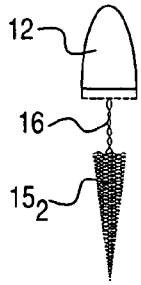
Figure 4B:
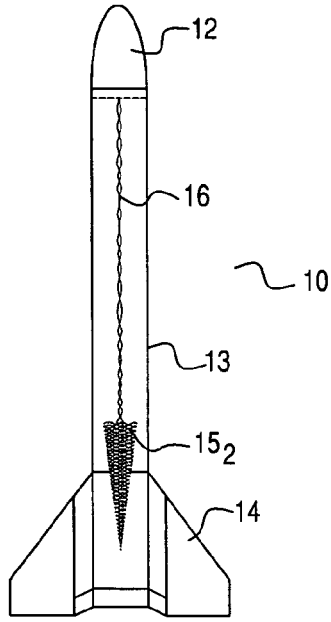
Figure 4C:
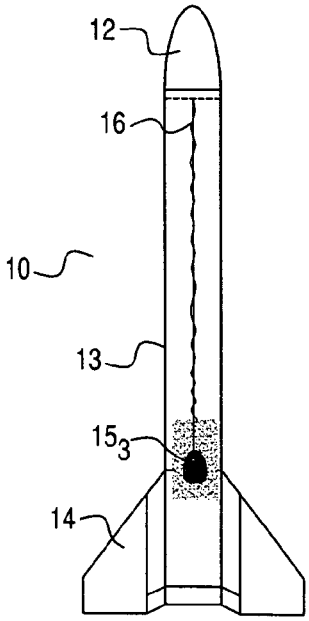
Figure 4C:
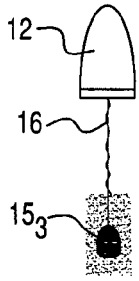
Figure 4D:
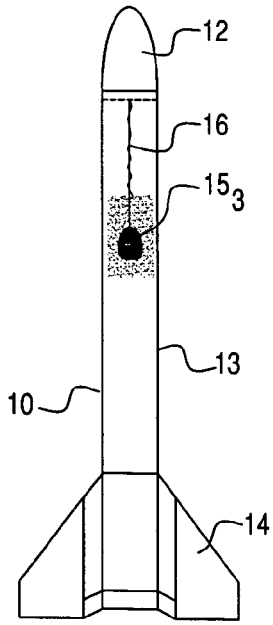
Figure 4E:
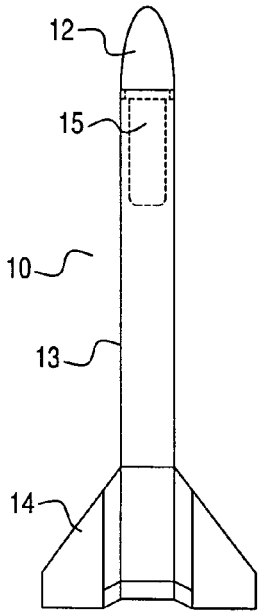
Figure 4E:
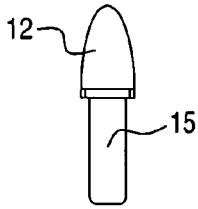
Figure 4F:
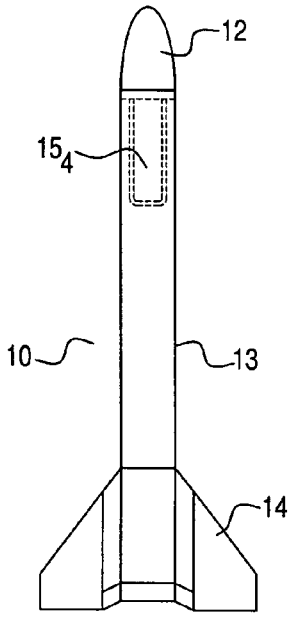
Figure 4F:
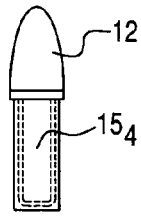
Figure 4G:
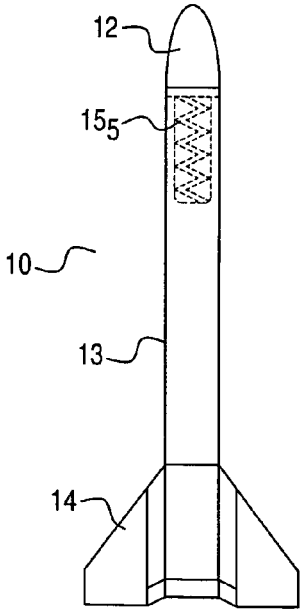
Figure 4G:
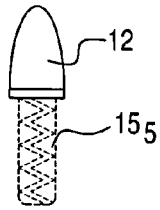

FIGS. 4A-4G are model rocket units 10 in accordance with the first exemplary embodiment of the present invention showing the different structural arrangements of model rocket conductive coupling devices 15 that are integral to or attached to nose cone 12 and that are affixed inside the rocket body tube 13. Whereas FIGS. 4A-4D utilizes a conductive coupling device in the form of conductive brush fibers $\mathbf{15}_2$ and $\mathbf{15}_3$ supported by a conductive wire wound stem 16 and attached to nose cone 12. FIG. 4A and FIG. 4B utilize a tapered brush $\mathbf{15}_2$ made from conductive plastic or foam as shown in detail at FIG. 4$A_1$. FIG. 4C and FIG. 4D utilize a bristled bottle or tube brush $\mathbf{15}_3$ made from soft conductive fibers or wire shown in detail at FIG. 4$C_1$. FIG. 4F utilizes a conductive coupling device in the form of a hollow conductive tube $\mathbf{15}_4$ as shown in detail at FIG. 4$F_1$. FIG. 4G utilizes a conductive coupling device in the form of a mechanical spring $\mathbf{15}_5$ as shown in detail at FIG. 4$G_1$. Varying the length of the rocket conductive coupling device 15 changes the engagement and placement of the reciprocal launch tube conductive coupling device 18 accordingly.

FIGS. 5A-5J are launch system units 24 in accordance with the first exemplary embodiment of the present invention showing the different structural arrangements of the launch tube conductive coupling devices 18 that are affixed inside launch tube 17 and the various arrangements of the electrode 22 and spark element devices 19 as mounted in mixing container 21. Whereas FIG. 5B and FIG. 5C utilizes a launch tube 17 with an end flange 17A and a conductive coupling device in the form of a mechanical spring $\mathbf{18}_2$ having an integral flange 18A that bisects spring $\mathbf{18}_2$ into upper and lower half portions as better shown in detail at FIG. 5$B_1$ and FIG. 5$C_1$. Integral flange 18A supports the upper spring portion $\mathbf{18}_2$ in the launch tube 17 and supports the lower spring portion $\mathbf{18}_2$ in mixing container 21. Electrode 22A in the form of a straight pin or shaft is mounted in mixing container 21 and aligned next to lower spring portion $\mathbf{18}_2$ to create a spark gap $\mathbf{22}_1$. In this configuration, the lower spring portion of $\mathbf{18}_2$ is utilized and substituted as the spark element device 19.

Figure 5A:
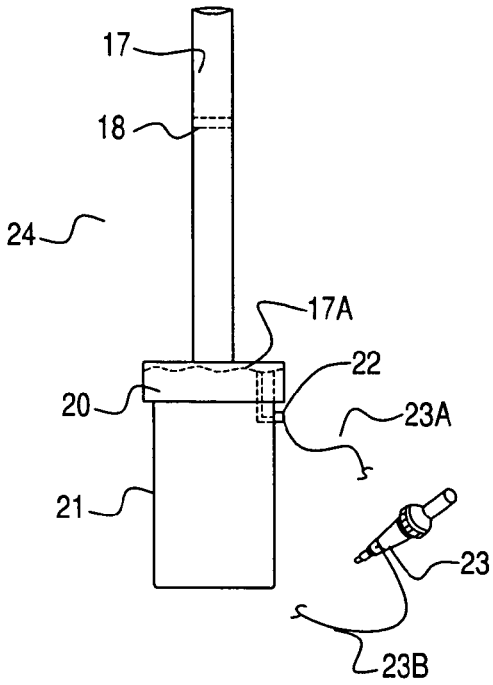
Figure 5A:
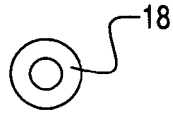
Figure 5B:
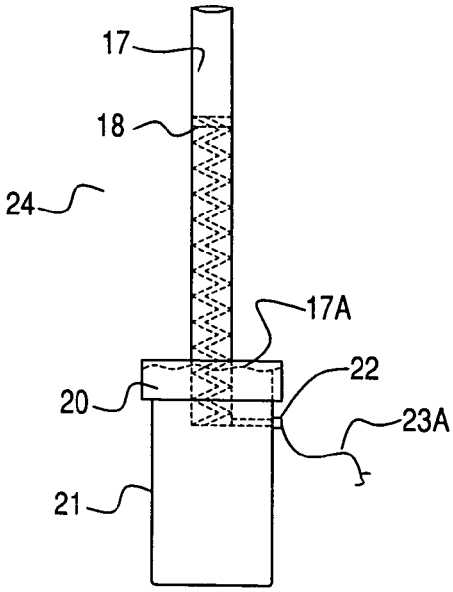
Figure 5B:
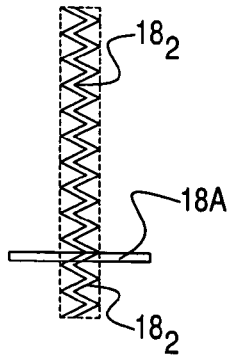
Figure 5C:
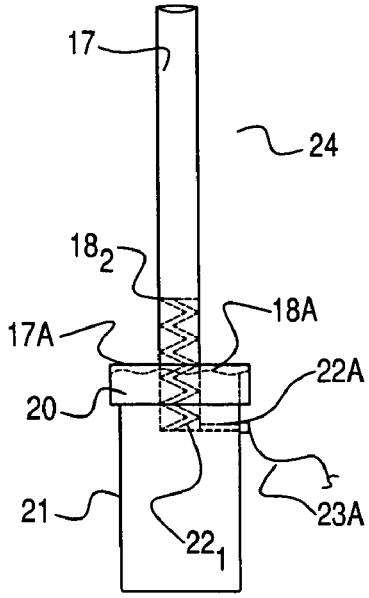
Figure 5C:
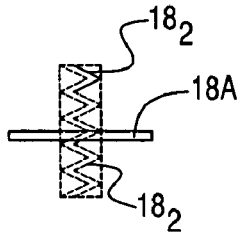
Figure 5D:
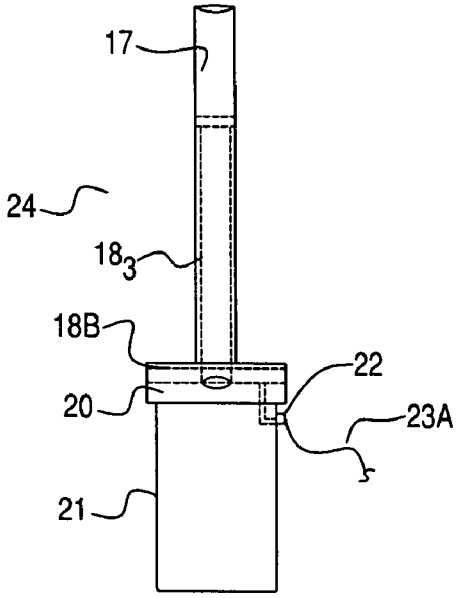
Figure 5D:
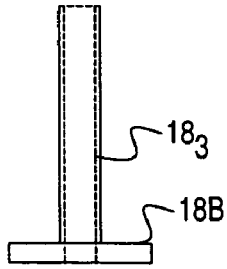
Figure 11A:
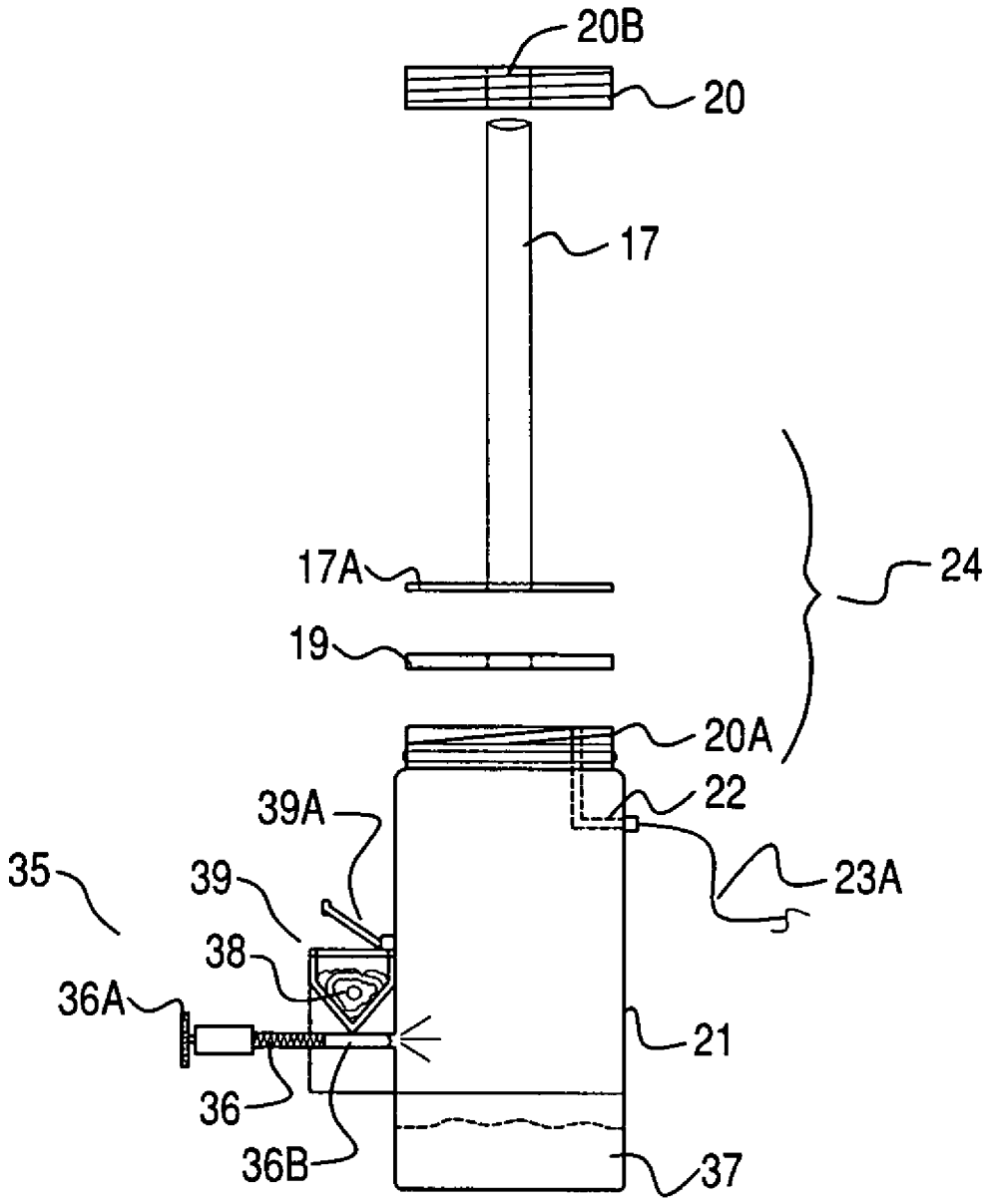
FIG. 11A, 11B, 11C, 11D are perspective and exploded views of launch tube assemblies, spark element devices, and mixing containers with a loader, in accordance with the present invention.
Figure 11B:
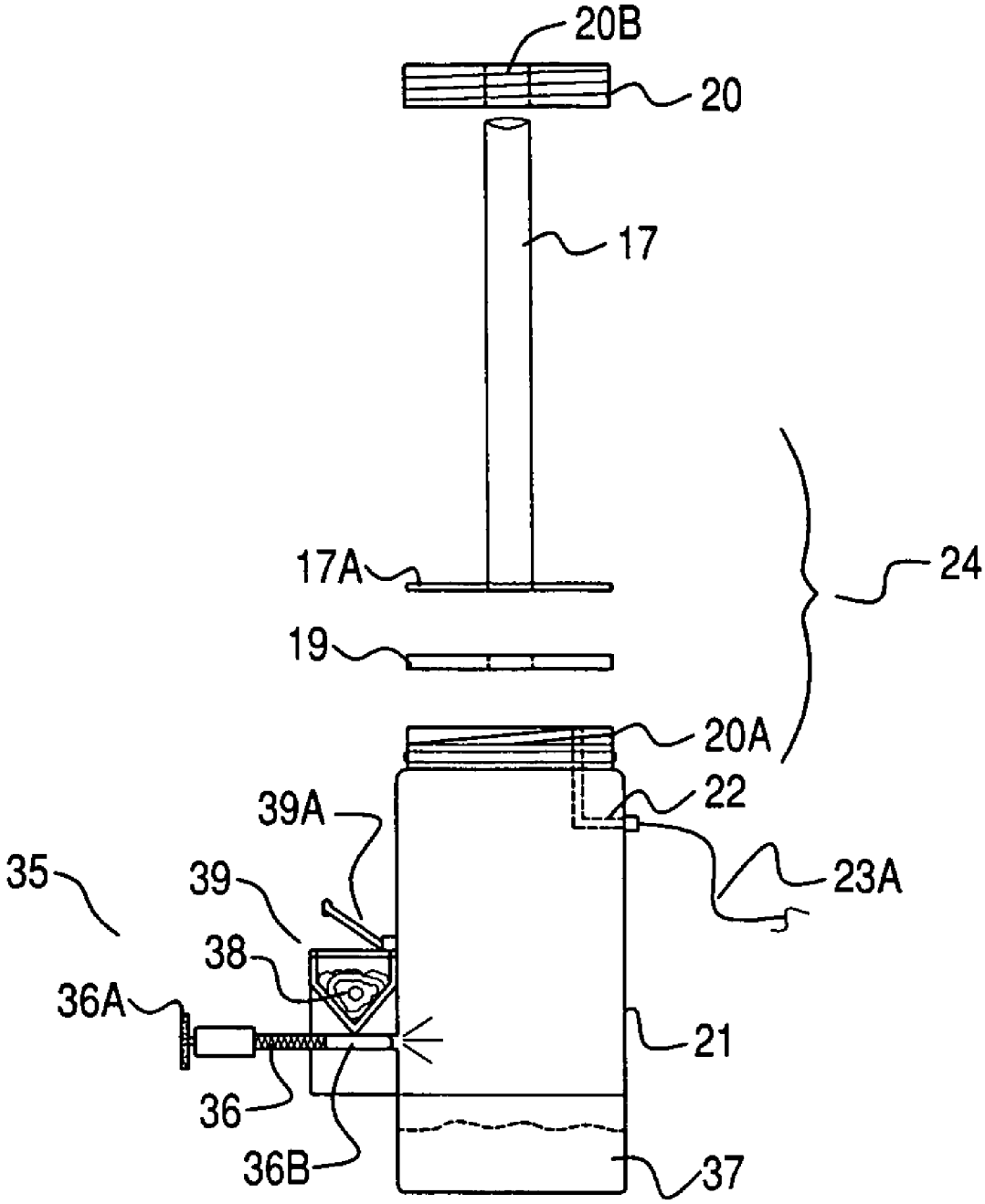
Figure 11C:
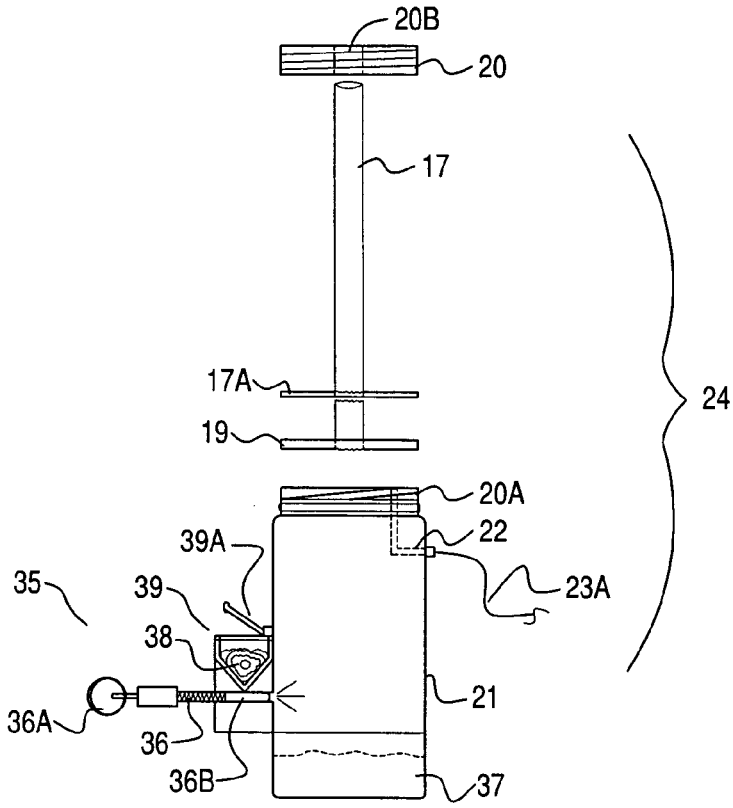

FIG. 5D utilizes a launch tube coupling device in the form of a hollow conductive tube $\mathbf{18}_3$ with an integral conductive end flange 18B shown in better detail at FIG. 11C. The conductive tube $\mathbf{18}_3$ is structurally made to slip-fit into the bottom of launch tube 17 with conductive end flange 18B supporting the assembly atop of mixing container 21. Electrode 22 is mounted in mixing container 21 and aligned directly under the conductive end flange 18B to create a spark gap $\mathbf{22}_1$. In this configuration, the conductive end flange 18B is utilized and substituted as the spark element device.

FIG. 5E utilizes a launch tube 17 with an end flange 17A shown in better detail at FIG. 11A, and a conductive coupling device in the form of metal foil or metallized finish $\mathbf{18}_4$. The metallizing covers a portion of the inner diameter of launch tube 17 and extends the length of tube 17 and out the bottom to cover and metallize a portion of end flange 17A. The metallic finish $\mathbf{18}_4$ can be applied by spraying, dipping, plating, impregnating or a combination thereof; and the metallic foil $\mathbf{18}_4$ applied by tape or glue. Launch tube 17 is supported by end flange 17A atop of mixing container 21. Electrode 22 is mounted in mixing container 21 and aligned directly under the metallized end flange 17A to create a spark gap $\mathbf{22}_1$. In this configuration, the launch tube end flange 17A is utilized and substituted as the spark element device.

FIGS. 5F-5J are launch system units 24 comprising of a launch tube 17 with integral end flange 17A utilizing the conductive coupling device arrangements aforementioned in FIG. 5A, FIG. 5D and FIG. 5E. However, there are variations of the electrode and spark element devices shown in FIGS. 5F-5J that can be achieved and are both safety and novel arrangements that will be apparent and explained here further, that are in accordance with the first exemplary embodiment of the present invention.

Whereas, FIG. 5F utilizes a spark element device 19 as shown in better detail at FIG. 11B and a spark assisting assembly 21A shown in detail at FIG. 5$F_1$. The spark assisting assembly 21A at FIG. 5$F_1$ consisting of a conductive angle plate 19A with an integral base 19$A_1$, a conductive spring 19B mounted to base 19$A_1$, the conductive spring 19B having a conductive weighted end tip or mounted ball 19C. The spark assisting assembly 21A is fitted inside mixing container 21 whereas conductive angle plate 19A rests against a side of mixing container 21 and integral base 19A sits on bottom of mixing container 21. When mixing container 21 is resting on a level surface, both the conductive spring 19B and the conductive mounted ball 19C align with electrode 22, mounted in mixing container 21 to create a spark gap $\mathbf{22}_1$. If mixing container 21 is tilted at more than 25 degrees conductive spring 19B will move in a direction away from electrode 22 and misalign conductive mounted ball 19C creating too large of a spark gap $\mathbf{22}_1$ preventing a spark to occur. Thus the spark assisting assembly 21A acts as a safety tilt switch preventing model rockets from being launched with an angle in excess of 25 degrees. Now, with spark element device 19 resting on top of mixing container 21, the spark element device 19 makes physical contact with the conductive angle plate 19A making it possible to transfer electrical power to the spark assisting assembly 21A.

Figure 5G:
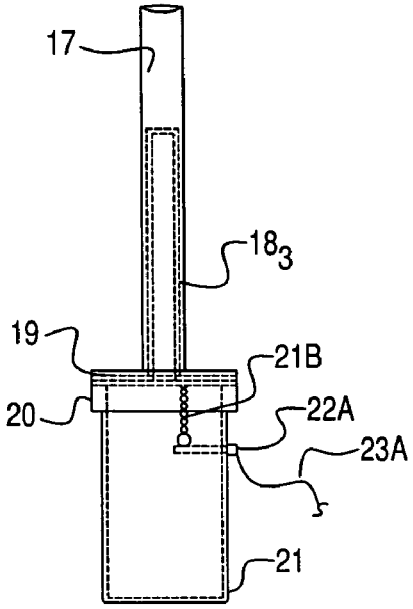
Figure 5G:
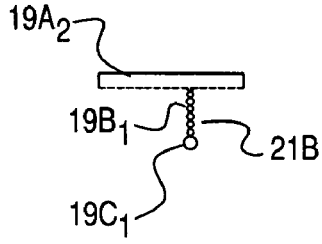

FIG. 5G utilizes a spark assisting assembly 21B as shown in detail $\mathbf{5}G_1$. The spark assisting assembly 21B consisting of a conductive base $\mathbf{19}A_2$ in the form of a flat washer, a conductive spring $\mathbf{19}B_1$ and a conductive weighted end tip or mounted ball $\mathbf{19}C_1$. The spark assisting assembly 21B is mounted with base $\mathbf{19}A_2$ atop of mixing container 21 with conductive spring $\mathbf{19}B_1$ and mounted ball $\mathbf{19}C_1$ facing downward toward the inside of mixing container 21 and aligned with electrode 22. When mixing container 21 is resting on a level surface, both the conductive spring $\mathbf{19}B_1$ and the conductive mounted ball $\mathbf{19}C_1$ align with electrode 22 mounted in mixing container 21 to create a spark gap $\mathbf{22}_1$. If mixing container 21 is tilted at more than 25 degrees conductive spring $\mathbf{19}B_1$ will move in a direction away from electrode 22 and misalign conductive mounted ball $\mathbf{19}C_1$ creating too large of a spark gap $\mathbf{22}_1$ preventing a spark to occur. Thus the spark assisting assembly 21B acts as a safety tilt switch preventing model rockets from being launched with an angle in excess of 25 degrees. The spark assisting assembly 21B can be electrically connected to the launch tube coupling device 18 with a strip of metallic foil tape or wire 18A affixed to the inner diameter of launch tube 17. As an alternate configuration, the launch tube 17 with conductive end flange 18B detailed at FIG. 5D can be utilized to transmit the electrical connection by making intimate contact by sitting on top of the spark assisting assembly 21B in FIG. 5G.

Figure 5H:
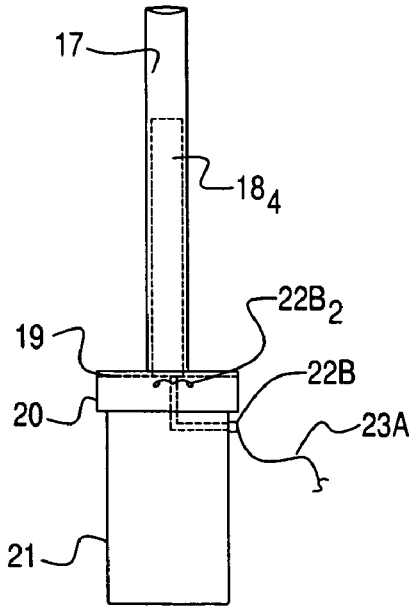

FIG. 5H utilizes a spark element device 19 and a spring elbow electrode 22B consisting of a conductive spring $\mathbf{22}B_1$ and a conductive weighted end tip or mounted ball $\mathbf{22}B_2$. Spring elbow electrode 22B is mounted in mixing container 21 and is set just below the spark element device 19. When mixing container 21 is resting on a level surface, both the conductive spring $\mathbf{22}B_1$ and the conductive mounted ball $\mathbf{22}C_1$ align straight up under the spark element device to create a spark gap $\mathbf{22}_1$. If mixing container 21 is tilted at more than 25 degrees conductive spring $\mathbf{22}B_1$ will move in a direction away from the spark element device 19 and misalign conductive mounted ball $\mathbf{22}C_1$ creating too large of a spark gap $\mathbf{22}_1$ preventing a spark to occur. Thus the spring elbow electrode 22B acts as a safety tilt switch preventing model rockets from being launched with an angle in excess of 25 degrees.

Figure 5I:
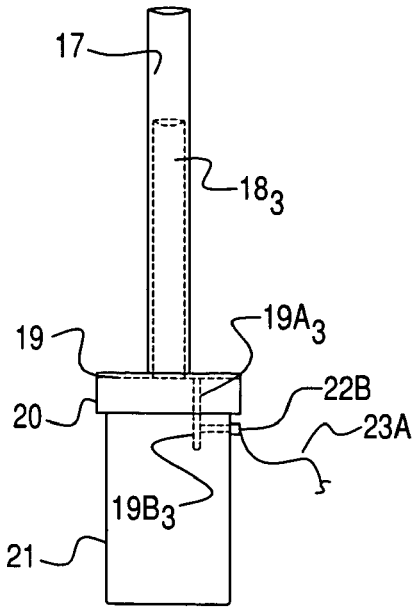
Figure 5I:
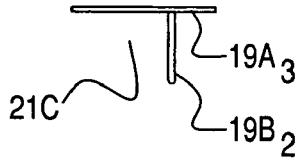

FIG. 5I utilizes a spark assisting assembly 21C as shown in detail $\mathbf{5}I_1$. The spark assisting assembly 21C consisting of a conductive base $\mathbf{19}A_3$ in the form of a flat washer, and a conductive rigid pin $\mathbf{19}B_2$. The spark assisting assembly 21C is mounted with base $\mathbf{19}A_3$ atop of mixing container 21 with conductive pin $\mathbf{19}B_2$ facing downward toward the inside of mixing container 21 and aligned with electrode 22A to create a spark gap $\mathbf{22}_1$. The spark assisting assembly 21C can be electrically connected to the launch tube coupling device 18 with a strip of metallic foil tape or wire 18A affixed to the inner diameter of launch tube 17. As an alternate configuration, the launch tube 17 with conductive end flange 18B detailed at FIG. 5D can be utilized to transmit the electrical connection by making intimate contact by sitting on top of the spark assisting assembly 21C in FIG. 5I.

Figure 5J:
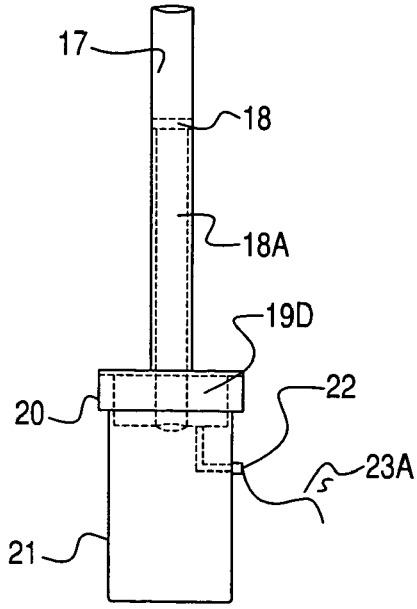
Figure 5J:
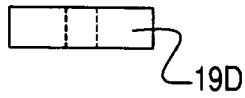

FIG. 5J utilizes a spark element device 19D that is in the form of a thick conductive foam or plastic gasket shown in detail $\mathbf{5}J_1$. Spark element device 19D is attached to the end of launch tube 17 to become an end flange and is installed atop of mixing container 21. Electrode 22 is mounted in mixing container 21 just below spark element device 19 to create a spark gap $\mathbf{22}_1$.

It will be appreciated by those skilled in the art that the model rocket units and the launch system units as described in the first embodiment are adaptable and interchangeably used with one another to form one or more combinations of model rocketry systems in accordance with the present invention.

It will be appreciated further by those skilled in the art that the model rocketry system can be made of any appropriate lightweight materials such as plastic, foam, balsa wood, cardboard, paper, conductive plastics and foams, metallic foils and tapes, as well as metal wire and springs or any combination thereof. Model rocketry components can be formed by die-cutting, injection molding or shaped from solid materials and can be assembled by press-fit and gluing methods. However, any other appropriate methods of manufacturing the model rocketry system that are well known in the prior arts are also within the scope of the present invention.

Figure 6:
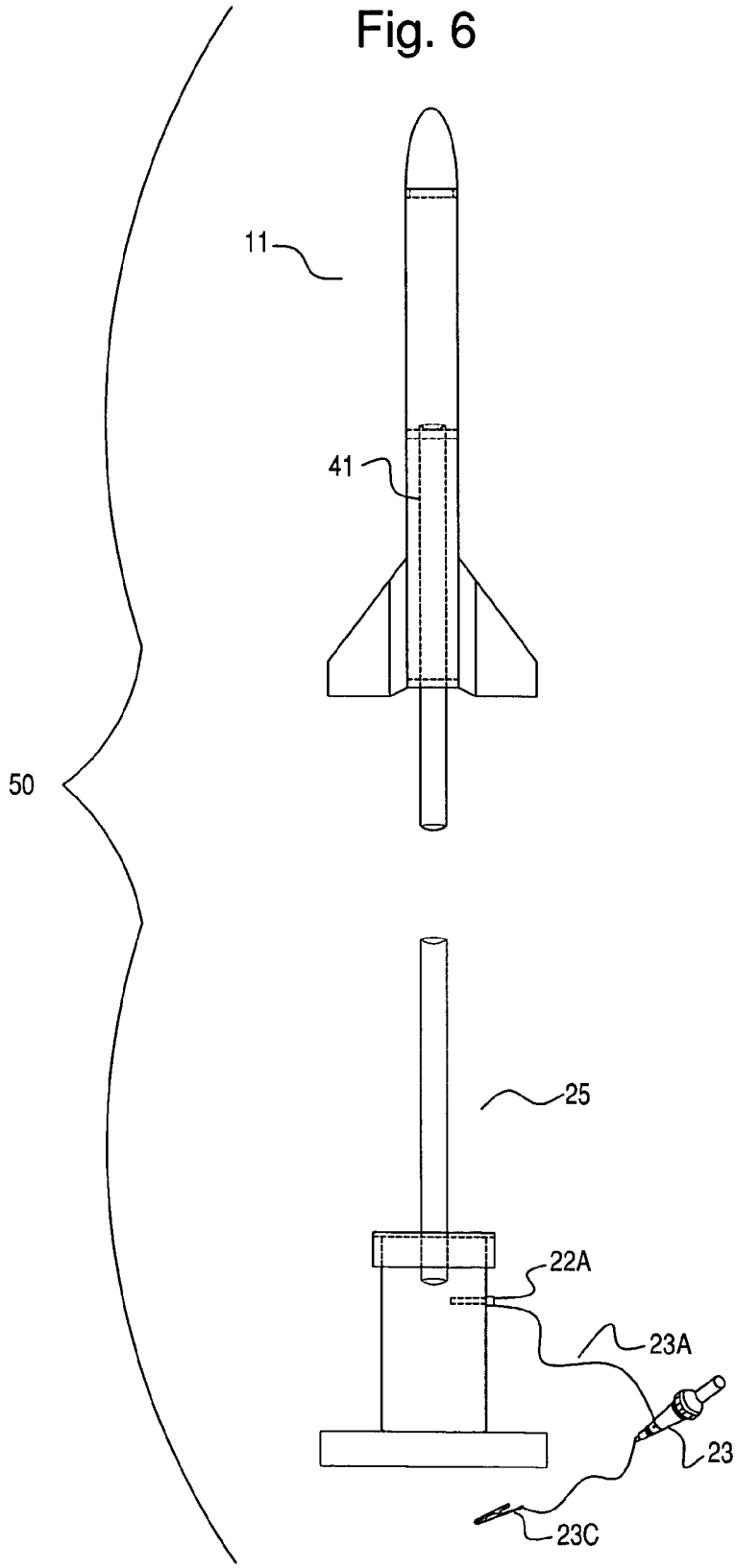
FIG. 6 is a perspective view of a carbide model rocket and launch system in accordance with the second embodiment of the present invention.

The second embodiment of the present invention shown in FIG. 6 is an improved model rocketry system illustrated generally at 50 comprises of a model rocket unit 11 and a modified launch system unit 25. Whereas, the model rocket unit 11 includes a hollow rocket body tube $\mathbf{13}_1$ with attached conductive stabilizer fins $\mathbf{14}_1$ and nose cone $\mathbf{12}_1$ shown in better detail at FIG. 7A. The model rocket unit 11 further incorporating a conductive tube assembly 41 comprising of a hollow extended conductive tube 41A with attached body ring 41B. The conductive tube assembly 41 is fitted into rocket body tube $\mathbf{13}_1$ and is attached by the body ring 41B with glue. The conductive tube 41A extends out towards the rear of body tube $\mathbf{13}_1$ and substantially further extending a length beyond the conductive stabilizer fins $\mathbf{14}_1$. The conductive tube assembly 41 is electrically connected to the conductive stabilizer fins $\mathbf{14}_1$ with a strip of metallic foil tape or wire 18A affixed to diameter of launch tube 17 and then attached to body ring 41B.

Figure 7A:
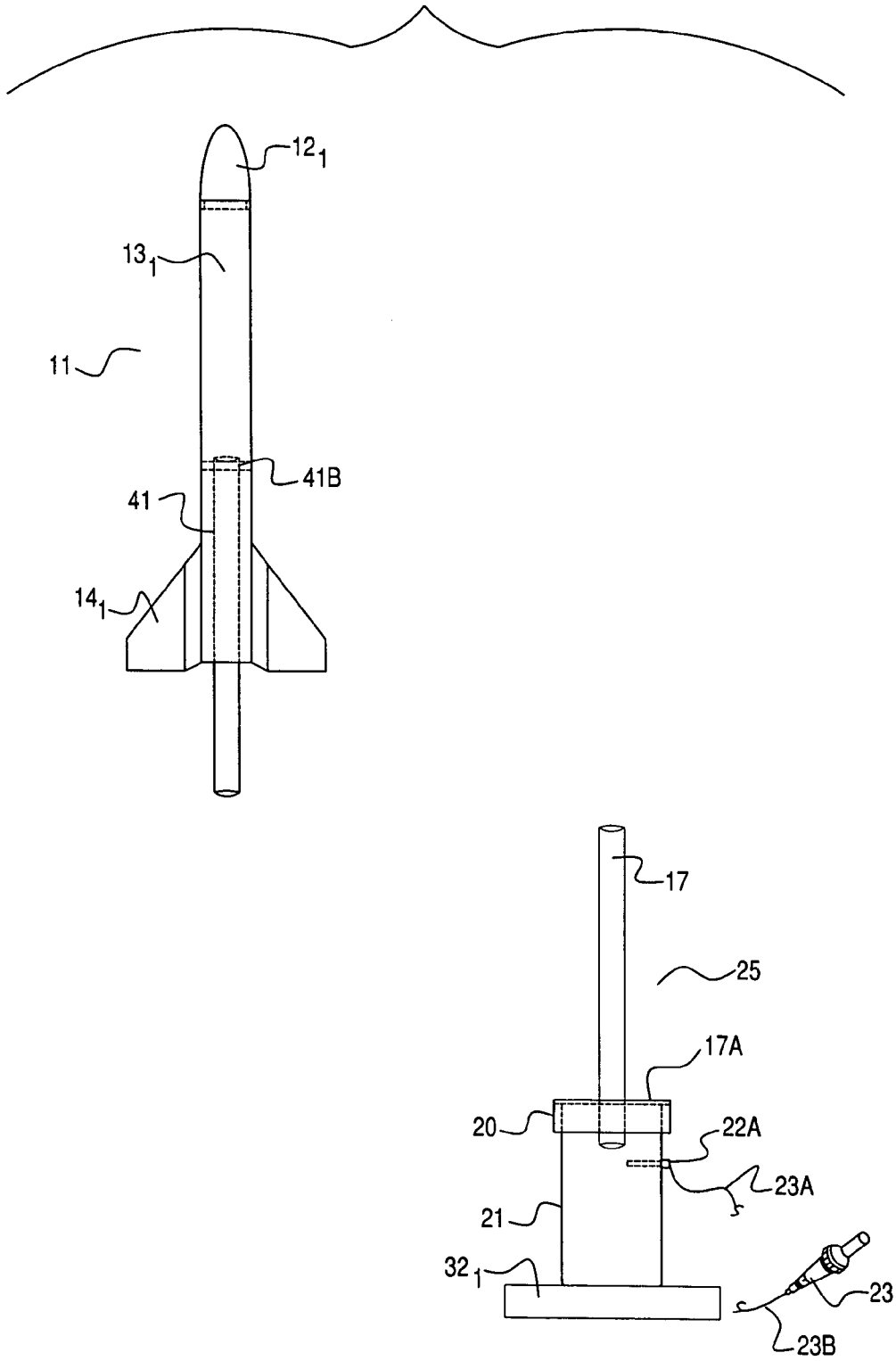
FIG. 7A, 7B, 7C, 7D are perspective views of model rocket units and launch system units in accordance with the second exemplary embodiment of the present invention showing different structural arrangements of model rocket and launch tube conductive coupling devices, electrodes and spark element devices.

The modified launch system unit 25 in accordance with the second embodiment of the present invention as shown in detail at FIG. 7A consists of a hollow launch tube 17 with an integral end flange 17A, closure cap 20, a mixing container 21 with integral base $\mathbf{32}_1$, an electrode 22A mounted in mixing container 21 and a spark generator 23.

Now, the model rocket unit 11 is structurally designed to join the modified launch system unit 25 by way of the conductive tube 41A slip-fitting into launch tube 17 and with rocket body tube $\mathbf{13}_1$ slip-fitting over launch tube 17. With model rocket unit 11 fully joined with launch system unit 25 the conductive tube 41A is aligned with electrode 22A to create a spark gap $\mathbf{22}_1$. In this configuration, the conductive tube 41A is utilized and substituted to perform as the conductive coupling device and spark element device as described in the first embodiment.

Figure 7B:
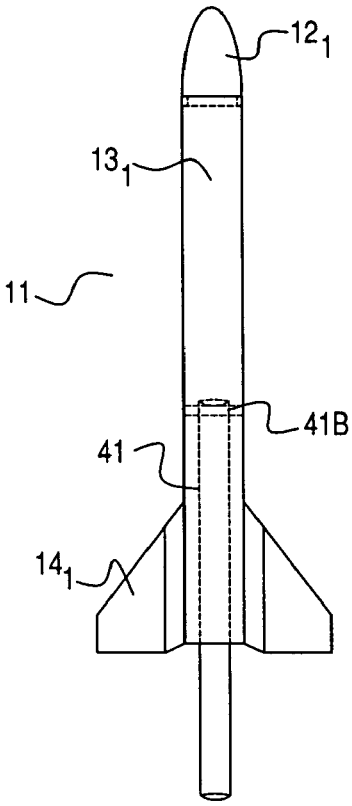
Figure 7B:
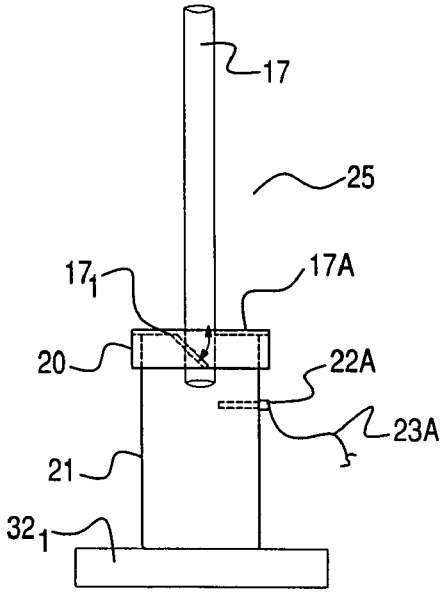
Figure 7C:
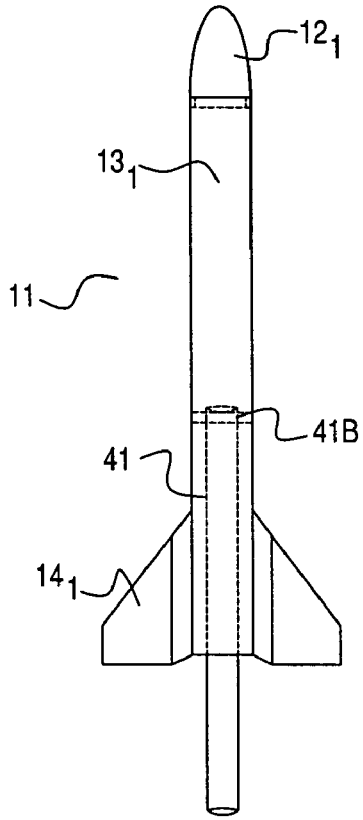
Figure 7C:
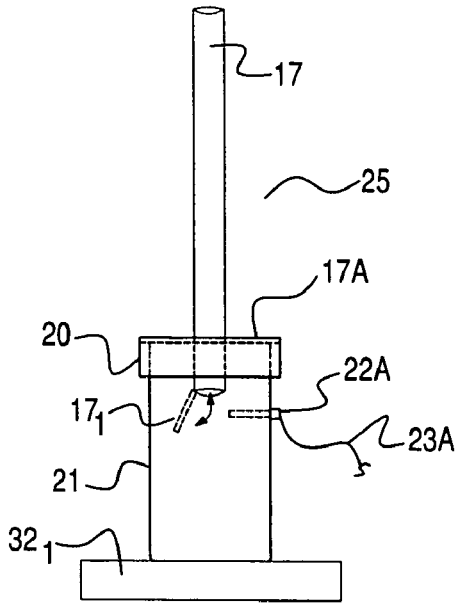

FIG. 7B and FIG. 7C are identical rocket model units 11 as described and shown in FIG. 7A. However, FIG. $\mathbf{7}B_1$ and FIG. $\mathbf{7}C_1$ are modified launch system units 25 consisting of a launch tube 17 with end flange 17A incorporating a first spring-loaded, swinging-door mechanism $\mathbf{17}_1$. The swing-door mechanism $\mathbf{17}_1$ is affixed inside the lower portions of launch tube 17 and is actively moved open or closed by conductive tube 41A by action of connecting and disconnecting the model rocket unit 11 to launch tube 17. When carbide material is introduced through the opening of launch tube 17, the carbide material falls to the bottom of launch tube 17 and rests on top of the swinging-door mechanism $\mathbf{17}_1$. As the model rocket unit 11 is joined to the launch tube system unit and the swinging-door mechanism is activated, the carbide material is then released into the mixing container 21 and combines with the water to make a solution that turns to a gas. The gas is ignited when a spark is initiated from a spark generator 23 between the electrode 22A and conductive tube 41A. Spark generator 23 is electrically connected to the launch system unit 25 with the ground wire 23A connected to electrode 22A and to the model rocket unit 11 with the positive wire 23B connected to a conductive stabilizer fin $\mathbf{14}_1$ with alligator clip 23C.

Figure 7D:
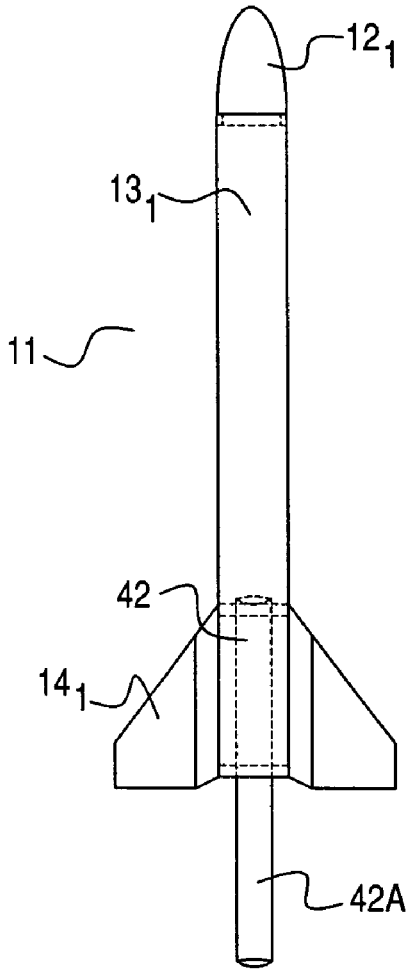
Figure 7D:
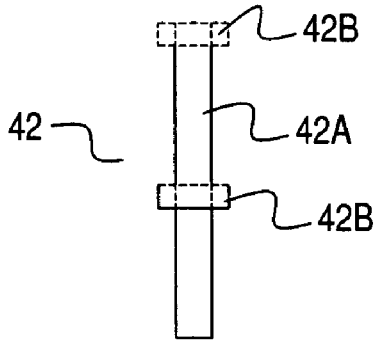

FIG. 7D is an alternate model rocket unit 11 in accordance with the second embodiment of the present invention having a conductive tube assembly 42 consisting of a hollow extended conductive tube 42A with two body rings 42B as shown in detail at FIG. $\mathbf{7}D_1$. The conductive tube assembly 42 is fitted into rocket body tube $\mathbf{13}_1$ and is attached by the two body rings 42B with glue. The conductive tube 42A extends out towards the rear of body tube $\mathbf{13}_1$ and substantially further extending a length beyond the conductive stabilizer fins $\mathbf{14}_1$. The conductive tube assembly 42 is electrically connected to the conductive stabilizer fins $\mathbf{14}_1$ with a strip of metallic foil tape or wire 18A affixed to diameter of launch tube 17 and then attached to body rings 42B.

It will be appreciated by those skilled in the art that the model rocket unit 11 in accordance with the second embodiment of the present invention are adaptable and interchangeably used with launch system units 24 of the first embodiment of the present invention.

Figure 8:
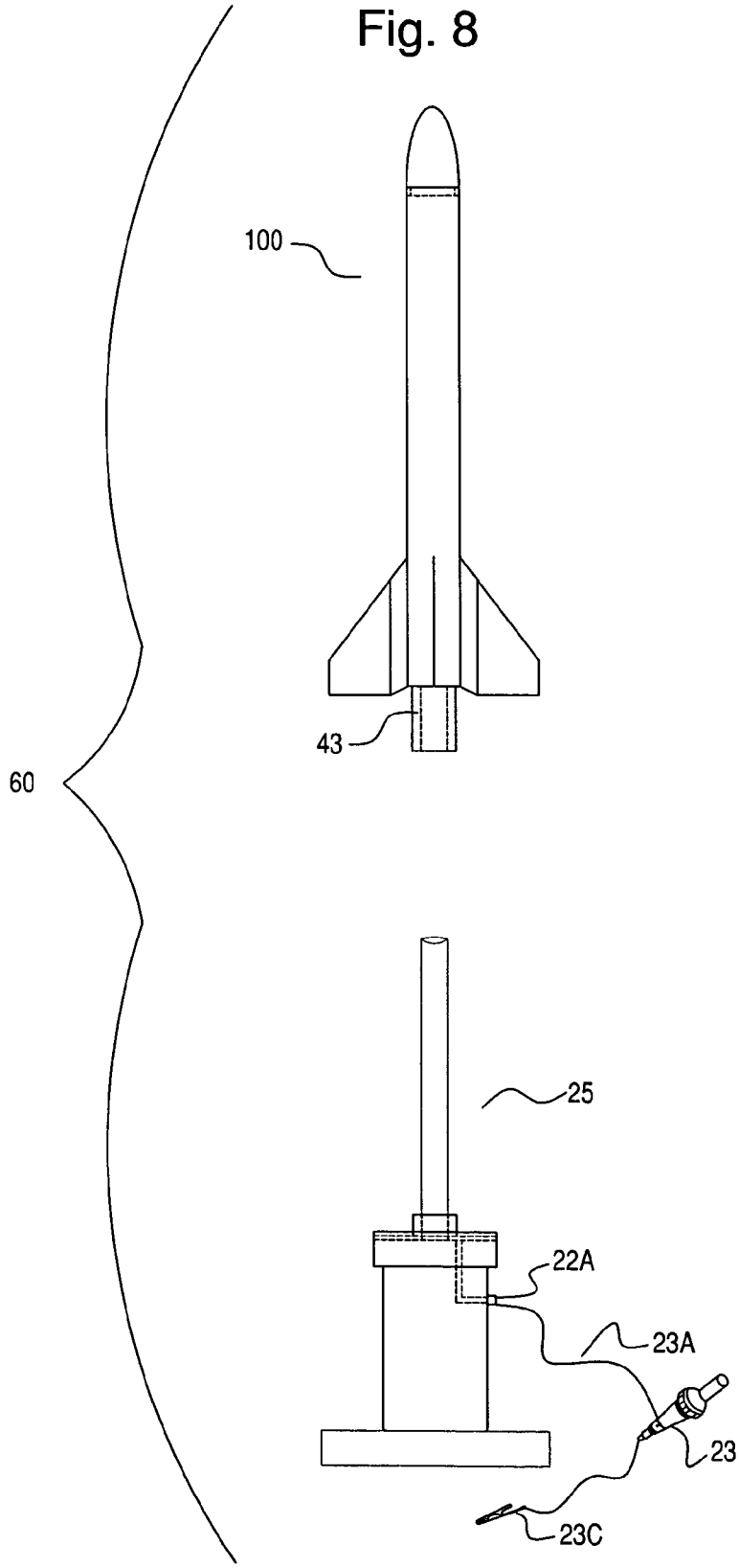
FIG. 8 is a perspective view of a carbide model rocket and launch system in accordance with the third exemplary embodiment of the present invention.
Figure 9C:
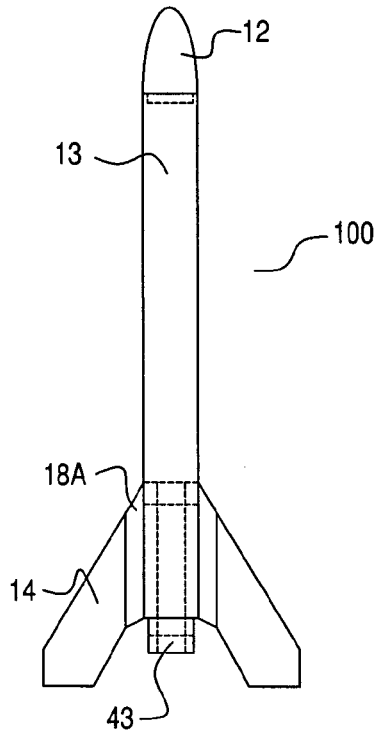

The third embodiment of the present invention shown in FIG. 8 is an improved model rocketry system illustrated generally at 60 comprising of a model rocket unit 100 and a modified launch system unit 26. Whereas, the model rocket unit 100 shown in detail at FIG. 9A and FIG. 9B includes a hollow rocket body tube 13 with attached conductive stabilizer fins 14 and nose cone 12, and a conductive tube assembly 43. The conductive tube assembly 43 consisting of an inner hollow conductive tube 43A with two conductive tube rings 43B and a conductive cover tube 43C as shown in better detail at FIG. $\mathbf{9}A_1$. The conductive tube assembly 43 is fitted into the rear of rocket body tube 13 and is attached by conductive cover tube 43C with glue. The conductive cover tube 43C extends out towards the rear of body tube 13 extending a length beyond the conductive stabilizer fins 14. The conductive tube assembly 43 is electrically connected to the conductive stabilizer fins 14 with a strip of metallic foil tape or wire 18A affixed to diameter of launch tube 17. FIG. 9C is an alternate rocket model unit 100 whereas the conductive tube assembly is fitted into the rear of rocket body tube 13 and is set to extend even length with the conductive stabilizer fins 14.

Figure 9D:
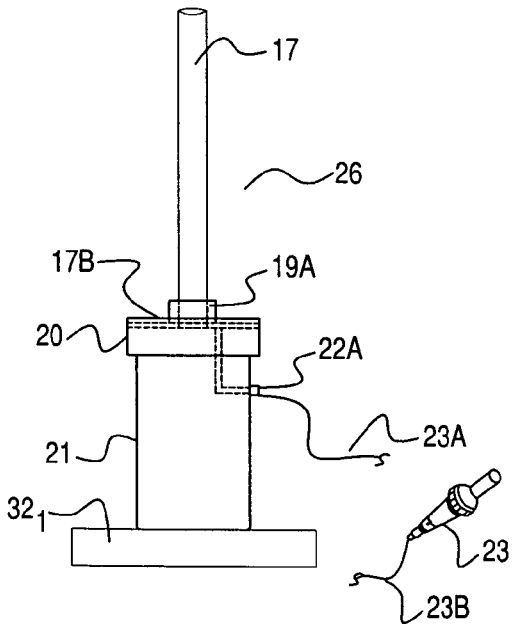
FIG. 9D is a perspective view of a launch system unit in accordance with the third exemplary embodiment of the present invention showing a launch tube conductive coupling device, electrode and spark element device.
Figure 9D:
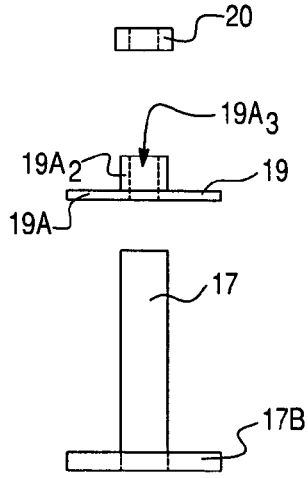

The modified launch system unit 26 in accordance with the third embodiment of the present invention as shown at FIG. 9D consists of a hollow launch tube 17 with an integral conductive end flange 17B, and a hub assembly 19A shown in detail at FIG. $\mathbf{9}D_2$. The hub assembly 19A includes a conductive end flange $\mathbf{19}A_1$, a non-conductive hub $\mathbf{19}A_2$ with an integral thru hole $\mathbf{19}A_3$. The launch system unit further including a closure cap 20, a mixing container 21 with integral base $\mathbf{32}_1$, an electrode 22 mounted in mixing container 21 and a spark generator 23.

Now, the launch tube 17 and hub assembly 19A are combined to form a unit with mixing container 21 when the launch tube 17 is mounted with the conductive end flange 17B resting atop of mixing container 21, and then the hub assembly 19A placed onto the launch tube 17 and seated to rest atop of conductive end flange 17B. The conductive end flange 17B and hub assembly 19A are then encapsulated and affixed to the mixing container with closure cap 20.

Model rocket unit 100 works in conjunction with the modified launch system unit 26 when the model rocket conductive tube assembly 43 is receivably joined to the launch tube 17 and hub assembly 19A. Whereas, the inner diameter of model rocket conductive tube 43A is compatibly designed as to structurally slip-fit over launch tube 17, and whereas, a portion of the outer diameter of the model rocket conductive cover tube 43C is compatibly designed as to structurally slip-fit and seat into hub assembly 19A. Now, with the model rocket unit 100 joined properly to the modified launch system unit 26, the bottom portion of the model rocket conductive tube assembly 43 makes physical contact with conductive end flange $\mathbf{19}A_1$ of hub assembly 19A and then the model rocket unit 100 and launch system unit 26 become a completed circuit and are electrically connected to each other. Now, mixing container 21 incorporates an electrode 22 spaced properly under the launch tube conductive end flange 17B to create a spark gap $\mathbf{22}_1$. A spark is initiated from a spark generator 23 between the electrode 22 and launch tube conductive end flange 17B. Spark generator 23 is electrically connected to the launch system unit 26 with the ground wire 23A connected to electrode 22 and to the model rocket unit 100 with the positive wire 23B connected to a conductive stabilizer fin 14 with alligator clip 23C. In this configuration the launch tube conductive end flange 17B acts as a spark element device in conjunction with the hub assembly 19A and the model rocket conductive tube assembly 43 acts as the conductive coupling device.

Figure 10:
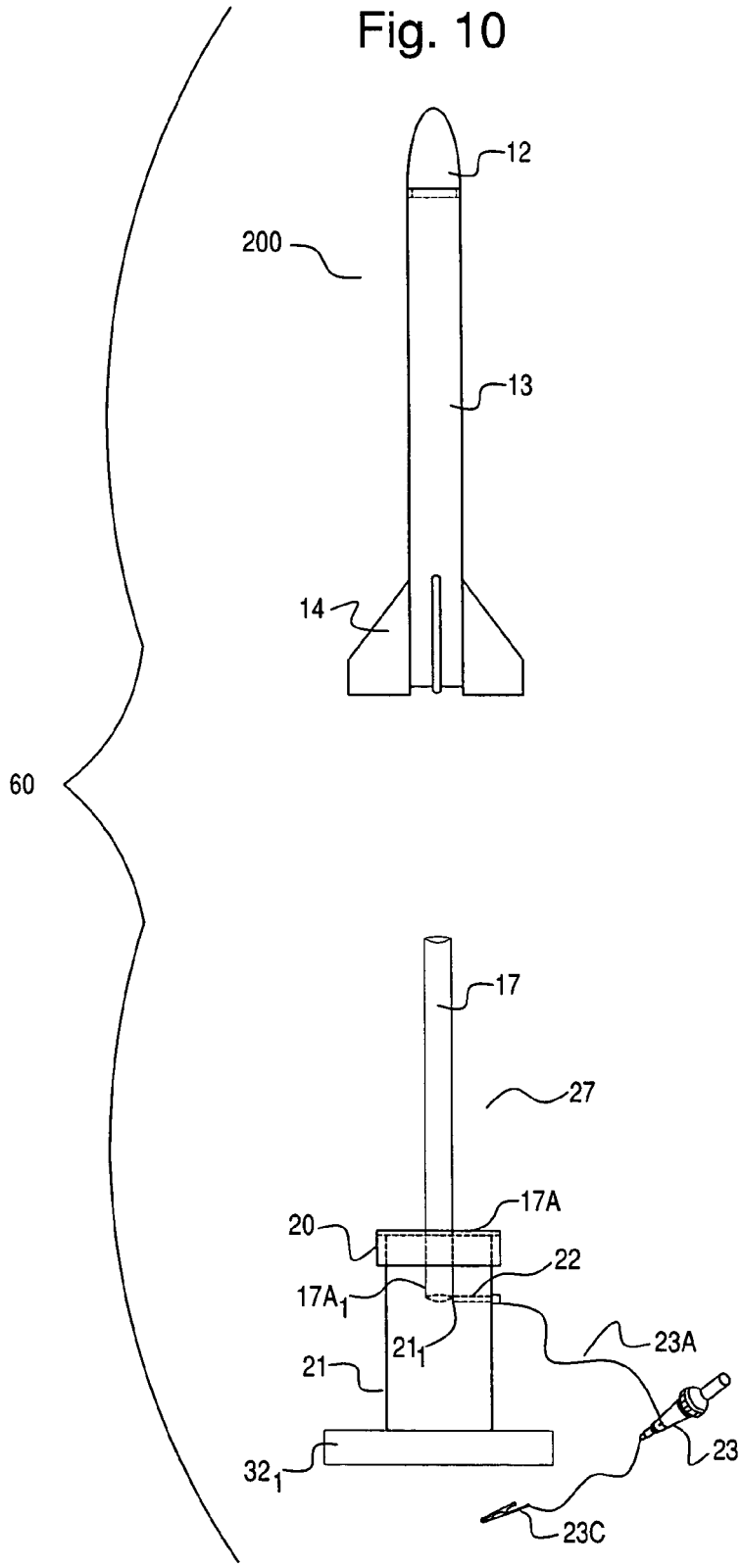
FIG. 10 is a perspective view of a carbide model rocket and launch system in accordance with the fourth embodiment of the present invention.

The fourth embodiment of the present invention shown in FIG. 10 is an improved model rocketry system illustrated generally at 70 comprising of a model rocket unit 200 and a modified launch system unit 27. Whereas, the model rocket unit 200 is a single unit molded rocket made from conductive foam or conductive plastic, consisting of a hollow body tube 13, stabilizer fins 14 and nose cone 12.

The modified launch system unit 27 in accordance with the fourth embodiment of the present invention consists of a molded, hollow launch tube 17 with integral end flange 17A made from conductive foam or conductive plastic, a closure cap 20, a mixing container 21 with integral base $\mathbf{32}_1$, an electrode 22 mounted in mixing container 21 and a spark generator 23. The molded launch tube 17 is mounted with integral end flange 17A resting atop of mixing container 21 and then encapsulated and affixed to the mixing container with closure cap 20.

The body tube 13 of model rocket unit 200 is structurally designed to slip-fit over molded launch tube 17. Both the model rocket 200 and the molded launch tube 17 are made of conductive material and when joined become a completed circuit and are electrically connected to each other.

Now, mixing container 21 incorporates an electrode 22 spaced properly next to the launch tube end $\mathbf{17}A_1$ to create a spark gap $\mathbf{22}_1$. A spark is initiated from a spark generator 23 between the electrode 22 and launch tube end $\mathbf{17}A_1$. Spark generator 23 is electrically connected to the launch system unit 27 with the ground wire 23A connected to electrode 22 and to the model rocket unit 200 with the positive wire 23B connected to a conductive stabilizer fin 14 with alligator clip 23C. In this configuration the entire model rocket unit 200 acts as a conductive coupling device and the entire launch tube 17 acts as a conductive coupling device and integral end flange 17A is the spark element device.

FIG. 11A-11C are launch system units 24 of different configurations and arrangements showing a mechanical loader 35 integral to mixing container 21. Whereas, mechanical loader 35 includes a filling chamber 39 with lid 39A to store carbide media 38 within, a spring loaded plunger 36 with handle 36A. When spring loaded plunger 36 is activated by pull back on handle 36A, a small amount of carbide media 38 is allowed to fall in front of plunger tip 36B. When handle 36A is released, the spring plunger 36 retracts and plunger tip 36B pushes the carbide media 38 into the mixing container 21. Carbide media 38 then falls into and mixes with the water 37 at the bottom of mixing container 21 to form a gas. Handle 36A can be made in the configuration of a lever, knob or ring as shown in FIG. 11A-11C respectively.

Figure 11D:
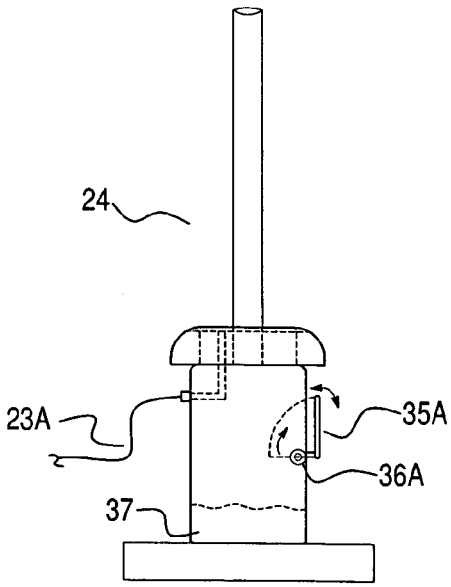
Figure 11D:
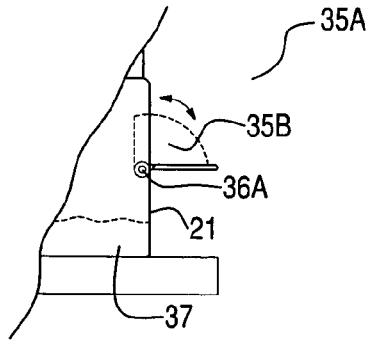

FIG. 11D is a launch system unit 24 showing an alternate design mechanical loader 35A. The mechanical loader 35A further including a spout chamber 35B and attached retractable spring 36A as shown in better detail at FIG. 11$D_1$. When spout chamber 35B is held in the open position, carbide media is then poured to fill the spout chamber 35B. When spout chamber 35B is released the retractable spring 36A pulls back spout chamber 35B dumping the carbide media into mixing container 21. Carbide media falls into and mixes with water 37 at the bottom of mixing container 21 to form a gas. It will be appreciated by those skilled in the art that the mechanical loader can be constructed of any appropriate design that attaches too or is integral too the mixing container and can be adapted to mount as a top loader or side loader typically.

Figure 12:
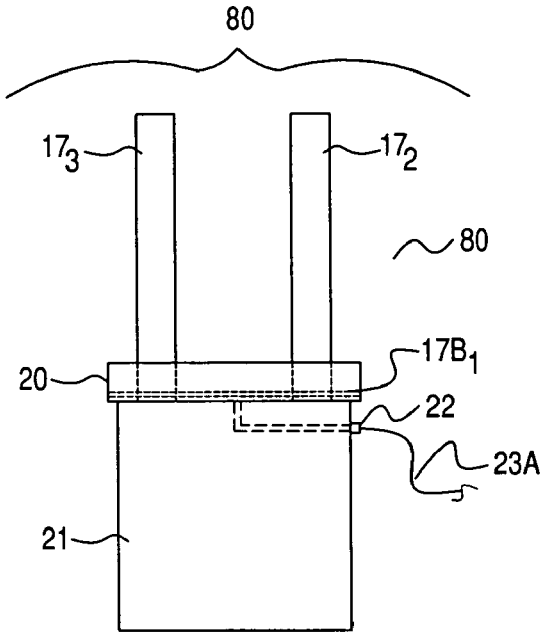
FIGS. 12, 13 & 14 are perspective views of multiple launch system in accordance with the present invention.

FIG. 12 is a multiple launch system 80 in accordance with the fifth embodiment of the present invention including a mixing container 21, multiple launch tube assembly 300, closure cap 20 and electrode 22. The multiple launch tube assembly 300 further comprises of two individual launch tubes 17$_2$ and 17$_3$ integrally mounted to conductive end flange 17$B_1$. Whereas, multiple launch tube assembly 300 is mounted with conductive end flange 17$B_1$ to top of mixing container 21 and encapsulated by closure cap 20. An electrode 22 spaced properly under conductive end flange 17$B_1$ creates a spark to ignite the combustible gas. Each launch tube 17$_2$ and 17$_3$ can receive a model rocket unit and upon ignition of the combustion gas the rapidly expanding gases will simultaneously launch the multiple rocket units into the air. One skilled in the art will appreciate that multiple launch system 80 can be adapted and designed to launch two or more model rockets simultaneously from a single mixing container with any of the model rocket and launch system embodiments in accordance with the present invention.

Figure 13:
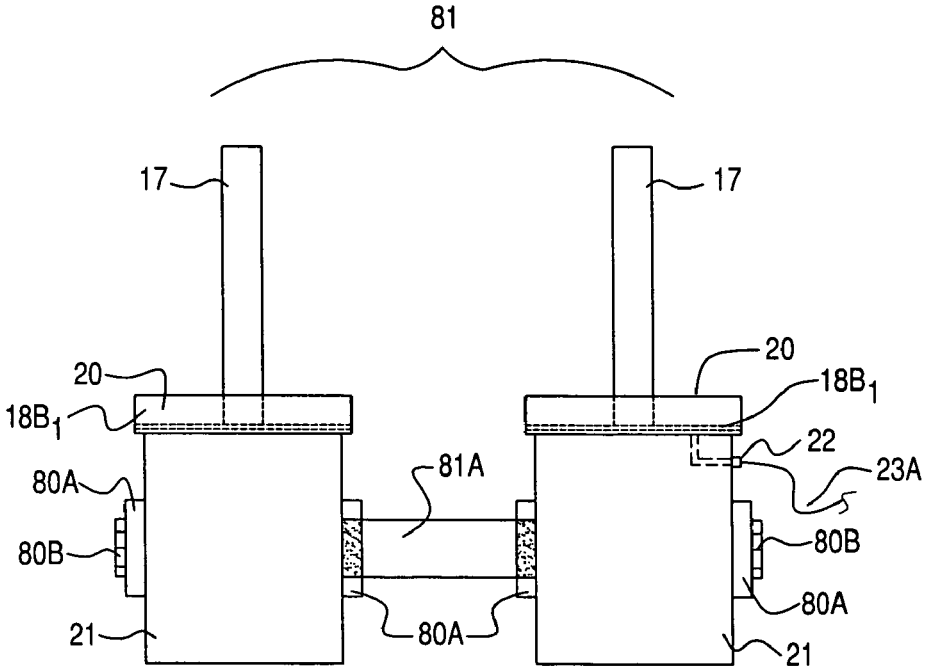

FIG. 13 is a multiple launch system 81 in accordance with the sixth embodiment of the present invention including a minimum of at least two mixing containers 21, two launch tubes 17, with the first launch tube having an integral end flange 17A, and with the second launch tube having an integral conductive end flange 17B. Whereas first launch tube 17 is mounted with integral end flange 17A to top of one mixing container 21 and encapsulated by closure cap 21 and the second launch tube 17 is mounted with integral conductive end flange 17B to top of a second mixing container 21 and encapsulated by closure cap 21. Whereas, two or more mixing containers 21 can be joined together with a connecting pipe 81A into reciprocal bosses 80A to form a gang or chain of multiple launch tubes 17 and mixing containers 21. Each additional launch tube can receive a model rocket unit and each mixing container can receive carbide and water mixture. Now, an electrode 22 is included in the second mixing container 21 and is spaced directly under conductive end flange 17$B_1$. A spark from the single mixing container 21 will ignite the combustion gases and in turn set off and/or ignite the joining mixing container(s) and simultaneously launch multiple rockets into the air. One skilled in the art will appreciate that multiple launch system 81 can be adapted and designed to launch multiple model rockets simultaneously from two or more mixing containers with any of the model rocket and launch system embodiments in accordance with the present invention.

Figure 14:
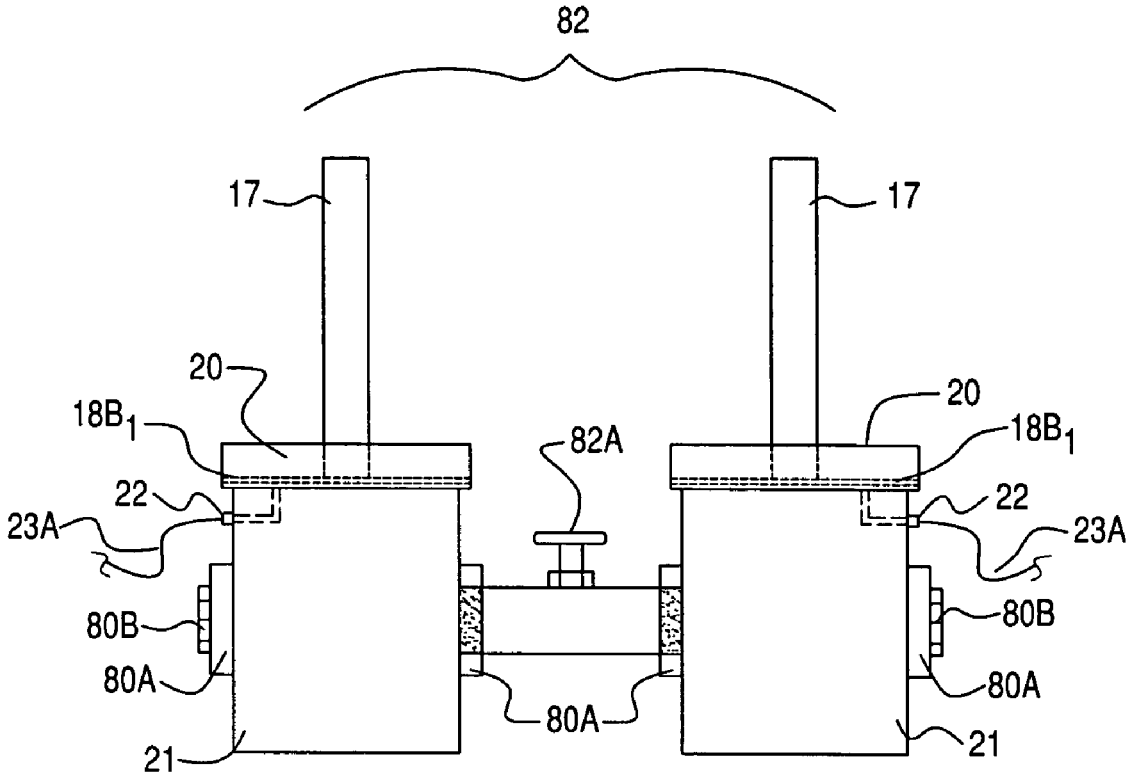

FIG. 14 shows an alternate multiple launch system 82 in accordance with the sixth embodiment of the present invention whereas, two or more mixing containers 21 can be joined together with a connecting shut-off valve 82A into reciprocal bosses 80A to form a gang or chain of multiple launch tubes 17 and mixing containers 21. Additionally all launch tubes 17 include an integral conductive end flange 17$B_1$ and all mixing containers include an electrode 22. Now, when shut-off valve 82A is in the open position the adjoining model rockets can be launched simultaneously. When the shut-off valve 82A is in the closed position the adjoining rockets can be ignited independently. The shut-off valve 82A allows the user to choose various combinations of the ignition sequence and method to launch model rockets.

One skilled in the art will appreciate that the alternate multiple launch system 82 can be adapted and designed to launch multiple model rockets simultaneously or individually from two or more mixing containers with any of the model rocket and launch system embodiments in accordance with the present invention.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A model rocket launching system in combination with a model rocket, said launching system comprising:

a base unit provided to be placed on a stable horizontal surface to thereby provide a stable platform for launching said model rocket, said base unit including a first mixing container containing a combustible mixture;

a first substantially hollow launch tube in fluid communication with said first mixing container, said first launch tube extending vertically upward from said base unit and terminating at a distal end, hollow tube having at least one opening to allow expanding gas to exit said first hollow launch tube;

an electrically conductive spark element device operatively associated with said first launch tube;

an electrical igniter provided to selectively ignite said combustible mixture in a controlled manner; and a single electrode disposed in said first mixing container and spaced from said spark element device so as to define a spark gap therebetween;

said model rocket including a substantially hollow rocket body tube disposed about and extending along a substantial length of said first hollow launch tube and provided with an electrically conductive member;

said model rocket further including a rocket conductive coupling device disposed within said substantially hollow rocket body tube and electrically connected to said electrically conductive member;

said electrically conductive spark element device is electrically connected to said rocket conductive coupling device of said hollow rocket body tube when said model rocket is mounted over said first launch tube;

said electrical igniter electrically connected to said single electrode and removably connected to said electrically conductive member of said model rocket so as to create an electrical spark between said single electrode spaced from said spark element device;

wherein when said igniter ignites said combustible mixture, expanding combusted gas is forced through said first substantially hollow launch tube and forces said model rocket vertically from said first launch tube.

2. The launching system according to claim 1, wherein said combustible mixture is generated by a mixture of water and calcium carbide.

3. The launching system according to claim 1, wherein said igniter comprises an electrical spark generator for generating said electrical spark in response to electrical current therethrough, said electrical igniter is selectively activated from a remote distance from said base unit.

4. The launching system according to claim 3, wherein said first launch tube includes a tube conductive coupling device having a first safety electrical contact electrically coupled to said electrically conductive spark element device, said rocket conductive coupling device of said hollow rocket body tube of said model rocket having a corresponding second safety contact provided to make an electrical connection with said first safety contact when said model rocket is properly mounted to said base unit, said electrical spark generator being electrically coupled in series to both said first and second electrical contacts to thereby prevent said spark generator from generating said electrical spark unless said model rocket is properly mounted to said base unit.

5. The model rocket launching system according to claim 1, wherein said rocket body tube of said model rocket includes at least one electrically conductive stabilizing fin, and wherein said electrically conductive member is said at least one electrically conductive stabilizing fin.

6. The launching system according to claim 5, wherein said electrical igniter has a first lead wire connected to said single electrode of said first mixing container of said base unit and a second lead wire removably connected to said at least one electrically conductive stabilizing fin of said model rocket.

7. The model rocket launching system according to claim 1, wherein said rocket conductive coupling device is attached to a nose cone of said model rocket so as to axially extend within said hollow rocket body tube.

8. The model rocket launching system according to claim 7, wherein said rocket conductive coupling device is in the form of a bristled brush made from soft electrically conductive fibers or wire, said bristled brush is attached to said nose cone through a conductive wire stem.

9. The model rocket launching system according to claim 8, wherein said bristled brush is tapered in the direction away from said nose cone of said model rocket.

10. The launching system according to claim 9, wherein said first launch tube includes a tube conductive coupling device electrically coupled to said electrically conductive spark element device, said rocket conductive coupling device of said hollow rocket body tube of said model rocket is provided to electrically couple with said tube conductive coupling device when said model rocket is properly mounted to said base unit.

11. The launching system according to claim 1, wherein said first launch tube includes a tube conductive coupling device electrically coupled to said electrically conductive spark element device, said rocket conductive coupling device of said hollow rocket body tube of said model rocket is provided to electrically couple with said tube conductive coupling device when said model rocket is properly mounted to said base unit.

12. The launching system according to claim 11, wherein said rocket body tube is made of an electrically conductive material so as to define said rocket conductive coupling device, and said first launch tube is made of an electrically conductive material so as to define said tube conductive coupling device integral with said electrically conductive spark element device.

13. The launching system according to claim 1, wherein said first launch tube is made of an electrically conductive material so that a distal end thereof defines said electrically conductive spark element device; and wherein said spark gap is formed between said distal end of said first launch tube and said single electrode.

14. The launching system according to claim 1, wherein said first launch tube further includes a spring-loaded swinging-door mechanism moved open or closed by action of mounting and removing said model rocket from said first launch tube of said base unit.

15. The launching system according to claim 1, wherein said electrically conductive spark element device includes an electrically conductive spring having an electrically conductive weighted end tip at the distal end thereof; said conductive weighted end tip is spaced from said single electrode so as to define said spark gap therebetween when said base unit is disposed on the stable horizontal surface; and wherein if said base unit is tilted at more than a predetermined angle, said conductive weighted end tip moves in a direction away from said single electrode so as to prevent the electrical spark to occur.

16. The launching system according to claim 1, wherein said base unit is further provided with a second substantially hollow launch tube in fluid communication with said first mixing container, said second launch tube extends vertically upward from said first mixing container; said second launch tube has at least one opening to allow expanding gas to exit said second launch tube; said second launch tube is provided to receive said model rocket.

17. The launching system according to claim 1, wherein said base unit further includes a second mixing container; said second mixing containers is provided with a second substantially hollow launch tube in fluid communication with said second mixing container; said second launch tube extends vertically upward from said second mixing container, said second launch tube has at least one opening to allow expanding gas to exit said second hollow launch tube; said second launch tube is provided to receive said model rocket and each of said second mixing container is provided to receive said combustible mixture.

18. The launching system according to claim 17, wherein said second launch tube is substantially identical to said first launch tube.

19. The launching system according to claim 17, wherein said first and second mixing containers are fluidly connected together with a connecting pipe so as to form a gang or chain of multiple launch tubes and mixing containers in order to launch multiple model rockets simultaneously from said first and second mixing containers.

20. The launching system according to claim 19, wherein said connecting pipe is provided with a connecting shut-off valve for selectively fluidly connecting said first and second mixing containers in order to launch multiple model rockets simultaneously or separately from said first and second mixing containers.

* * * * *